US009134101B2

(12) United States Patent
Griffith

(10) Patent No.: US 9,134,101 B2
(45) Date of Patent: Sep. 15, 2015

(54) BOWFISHING SLIDER

(71) Applicant: Larry Griffith, Lake City, MI (US)

(72) Inventor: Larry Griffith, Lake City, MI (US)

( * ) Notice: Subject to any disclaimer, the term of this patent is extended or adjusted under 35 U.S.C. 154(b) by 106 days.

(21) Appl. No.: 13/971,830

(22) Filed: Aug. 20, 2013

(65) Prior Publication Data

US 2015/0057115 A1 Feb. 26, 2015

(51) Int. Cl.
*F42B 6/04* (2006.01)

(52) U.S. Cl.
CPC ..... *F42B 6/04* (2013.01)

(58) Field of Classification Search
CPC ..... F41B 5/1488; F42B 6/04
See application file for complete search history.

(56) References Cited

U.S. PATENT DOCUMENTS 3,227,454 A * 1/1966 Ellenburg ..... 473/586
5,335,439 A * 8/1994 Horton ..... 43/6
2002/0198072 A1* 12/2002 LaSee ..... 473/578

* cited by examiner

*Primary Examiner* — John Ricci
(74) *Attorney, Agent, or Firm* — Smith Risley Tempel Santos LLC; Gregory Scott Smith

(57) ABSTRACT

A bowfishing arrow with a medium that receives a slider and allows the slider to traverse a substantial length of the arrow shaft. The slider can receive a fishing line and when being drawn, the slider allows the slider and fishing line to remain in front of the bow and, upon release, the slider traverses to the back of the arrow during flight but, the slider at all times remains in front of the bow.

20 Claims, 12 Drawing Sheets

BOWFISHING SLIDER

BACKGROUND

From the early days of man, there were those that were referred to as gatherers, and then, there were the hunters. And although the origin of the hunter's adventures was one meant for survival, the innate character of mankind still thrived on the sport of the hunt. One of the earlier, and safer forms of the hunt, was fishing, also referred to as angling. Fishing has roots that extend back to as early as 2000 BC in which an ancient Egyptian angling scene depicts men with sticks and lines, as well as nets, seeking their prey. Today, angling as a sport is main-stream with fishing tournaments, sponsored anglers, fishing shows on primetime, and the like.

Another form of hunting that dates back at least to the Stone Age is bow hunting. The oldest arrow heads were discovered in Africa and were dated to be from before 25,000 BC. Scientists have theorized that the bow was created as an off-shoot of the spear-thrower. Somewhere around 25,000-18,000 BC, man began to use fire to further harden his stone arrowheads and added feathers to his arrows in order to improve accuracy. Approximately around 2800 BC, the first composite bow was produced by the Egyptians. This composite bow was made from wood, tipped with animal horn and held together with animal sinew and glue. Unstrung, it resembled a "C" shape and would have required 2 people to string it. The bowstring was made from "catgut" (sheep intestines). The arrows used were extremely light, could be shot 400 yards using the composite bow and would easily penetrate the armor of that time period. The Egyptians used archers on the back of light chariots who were highly trained and skilled and could easily outflank an enemy army with devastating effect.

It shouldn't be all that surprising, that given the adventurous and inventive nature of mankind, that eventually these two sports would be combined. Today, the popular sport of bowfishing has a national organization called the Bowfishing Association of America, which was originally established in 1990 to track of bowfishing tournaments in the United States, and which now lobbies for the rights to bowfish and promote the sport.

Bowfishing is a method of fishing that uses specialized archery equipment to shoot and retrieve fish. Fish are shot with a barbed arrow that is attached with special line, typically to a reel mounted on the bow or elsewhere. Some freshwater species commonly hunted include common carp, grass carp, bighead carp, alligator gar, and paddlefish. In saltwater, rays and sharks are regularly pursued. An even more recent variation in the sport is aerial bowfishing in which the hunter shoots fish as they leap from the water.

Bowfishing equipment generally includes a bow, arrows, line, reels and glasses. Some of the bows used by bowfishermen are simple and do not include any sights—aiming is by line-of-sight judgment down the arrow. There are a couple of types of rests including the hook and roller rest. Most bows have little to no let off and not much draw weight. There are two main types of bows: traditional and recurve bows. The traditional bows are like long bows. In more modern times compound bows came into use. They use a system of pulleys to help the archer. Modern bows can have as much as 120 pounds (50 kg) draw weight. The crossbow is also sometimes used in the sport of bowfishing and has its own advantages including the use of a reel.

The arrows used in bowfishing are typically heavier and stronger than arrows used in other types of archery and are most commonly constructed of five-sixteenth inch fiberglass, but, other arrows can be found to be constructed of solid aluminum, carbon fiber, and carbon fiber reinforced fiberglass. Bowfishing arrows generally lack fletching, as it can cause the arrow to flare to one side or another underwater and they are not required at the relatively short ranges associated with bowfishing. Line is attached to the arrow by tying to a hole in the arrow shaft or through the use of a slide system.

Bowfishing line is often made from braided nylon, Dacron, or Spectra. Commonly used line weights range from eighty to four-hundred pound test, with six-hundred being used when bowhunting for alligators. Line color is normally selected to be lime green, white, or neon orange.

The bows used in bow fishing are similar to the traditional bow but, traditionally have usually been very simple. Most of the bow fishing bows did not include sights and aiming was performed by line-of-sight judgment down the arrow. Most of the bows have little to no let off and not much draw weight. This differs with what one has available and personal preference. There are two main types of bows (a) traditional bows—long bows and (b) recurve bows. In more modern times, compound bows have been used. These compound bows use a system of pulleys to help the archer. Modern bows can have as much as 120 pounds (50 kg) draw weight.

The crossbow has also been used in bow fishing both from above the surface and below the surface of the water.

Several types of reels are commonly used in bowfishing: Hand-wrap, spincast, closed reels and retriever. Hand-wrap reels are the simplest reels consisting of a circular spool that line is wrapped onto by hand and then secured in a line holding slot. When the arrow is shot, the line comes free from the line holder and feeds off the spool. Hit fish are fought and retrieved by pulling the line in hand over hand. Hand-wrap reels are the least effective at fighting arrowed fish, but they can be used in conjunction with a float system to shoot and fight fish. Retriever reels have a "bottle" which holds the line in place. When shot the line comes out either until the shot goes too far and the line runs out or the hunter pushes down a stopping device which can be used to keep a fish from traveling too far. Some retriever reels have slots cut in them and are known as slotted retriever reels. They are more commonly used for alligator, alligator gar, shark and other big game that will take more time to chase down than smaller game fish.

An important aspect to bowfishing is having a good visual of the target. To see the fish in the water on a sunny day, polarized sun glasses are helpful. The polarized lens can cut the glare on top of the water to make it easier to see below the surface. Different tints and lens colors are used depending on the color of water the hunter is fishing in, from darker brown to clearer blue and green. At night glasses are unnecessary, as light is used to see through the water.

Most states allow bowfishing of the so-called "rough" fish. Those are suckers, eels, perch, gars, carp and the like. Gars and carp are the most popular and usually the most plentiful. Carp can be found in almost any body of water, large or small, year round. The best times are during the spawn in spring or after some good rainfall when the water in the shallows is deeper. The only things needed are bow, arrows, and waders. At times the fish can be so involved in spawning, the bowman can walk out among them and shoot. Some bow fishermen use field arrows so that they can just flip the fish onto shore without having to disengage the barbs to get the arrows out.

As the sport of bowfishing continues to grow in popularity, the bow fisherman naturally seeks inventive mechanisms and techniques to improve on the sport, increase the bow fisherman's productivity, and decrease the laborious aspects of the sport. The present disclosure is focused on such an inventive improvement.

BRIEF SUMMARY

The various embodiments presented herein are directed towards a slider system for a bowfishing arrow or system, a bowfishing arrow with a slider system, and/or a bowfishing bow and arrow combination with a slider system, all that operate to prevent the bowfishing line from tangling with the bow string during release, thereby reducing the risk of the arrow snapping back and causing harm to the huntsman. The slider system, in general, includes a slide to which the string or line can be attached and that traverses a portion of the length of an arrow shaft by sliding in one or more channels formed in the body of the arrow or, a channel secured to the body of the arrow.

In operation, the bowfishing line is tied to the slider which has one or more legs or walls that are inserted into the one or more channels of the shaft of an arrow. The slider is maintained in front of the archer's hand and the arrow rest during drawback. During release, the arrow flies forward, and the momentum of the arrow relative to the slide results in the slide traversing through the channel of the arrow shaft until the slide hits a stop, which can located proximate to the back end of the arrow.

Various embodiments may include arrow shafts with one or more channels for holding one or more sliders, various channel shapes and various techniques for reducing friction between the slide and the channel. The channels may be formed in the body of the arrow shaft or attached to the outside of the arrow shaft. Other embodiments, variations and features are described in the detailed section.

DETAILED DESCRIPTION OF EMBODIMENTS

Presented in this description are various embodiments, as well as features and aspects that may be incorporated into one or more embodiments, of a slider system that can be used in conjunction with bowfishing arrows. As such, the present description is directed towards providing a bowfishing system that includes a slider and may include an arrow. The slider is suitable for receiving fishing line, which can be attached to the slider such that during operation, the line remains in front of the bow and the huntsman, thereby reducing the risk of entanglement and arrow snapback.

Figure 1A:
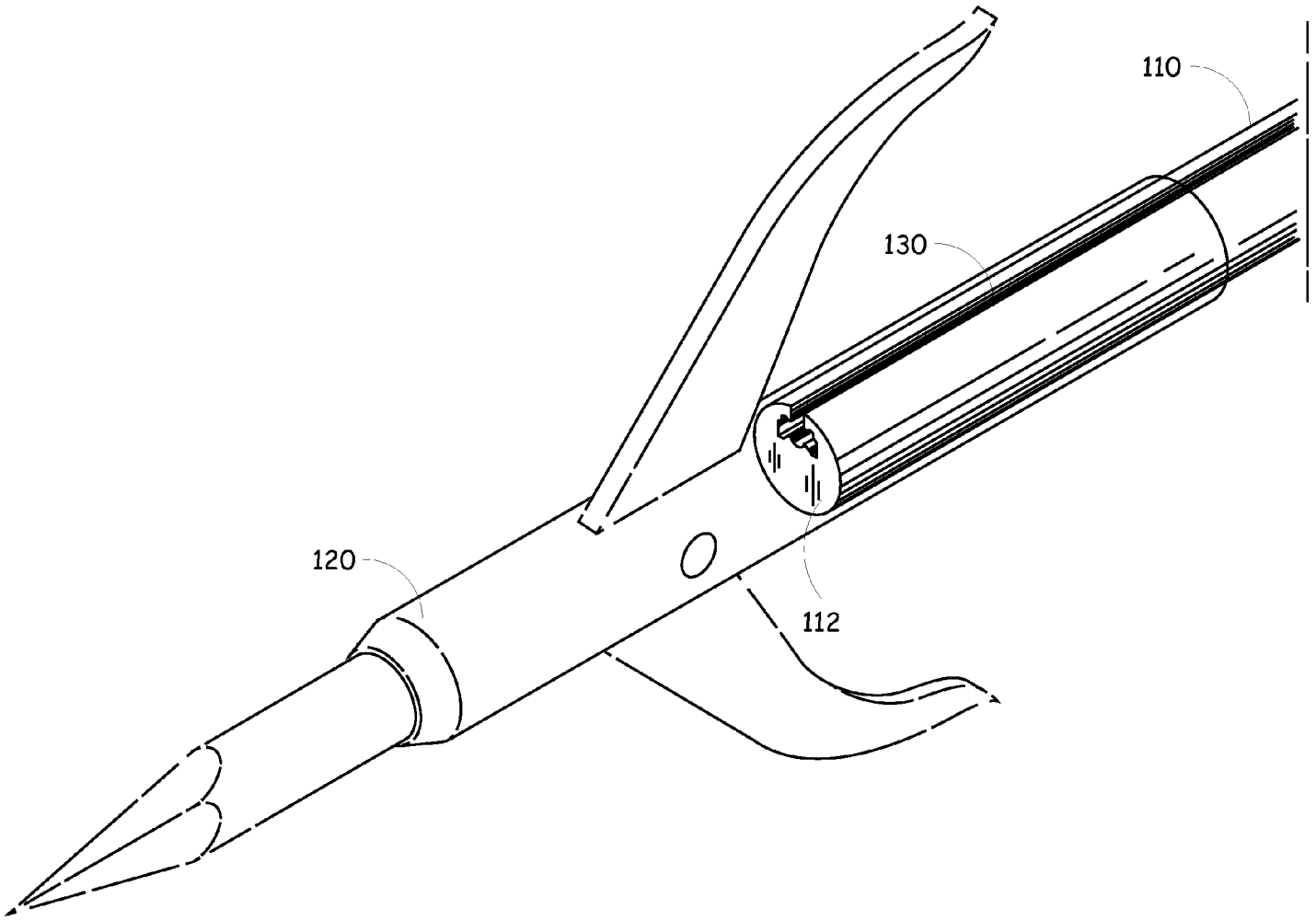
FIG. 1A is an environmental drawing illustrating one embodiment of the slider structure.

FIG. 1A is an environmental drawing illustrating one embodiment of the slider structure. As illustrated, an arrow shaft 110 is illustrated as including a load 120. The arrow shaft 110 is illustrated as including a single channel 130 that is shown as extending from or proximate to a front end 112 of the shaft 110. Although it is not necessary for operation of the various embodiments, the channel 130 is shown as extended all the way to and through the end 112 which is an embodiment that greatly eases the manufacture of the shaft.

Figure 1B:
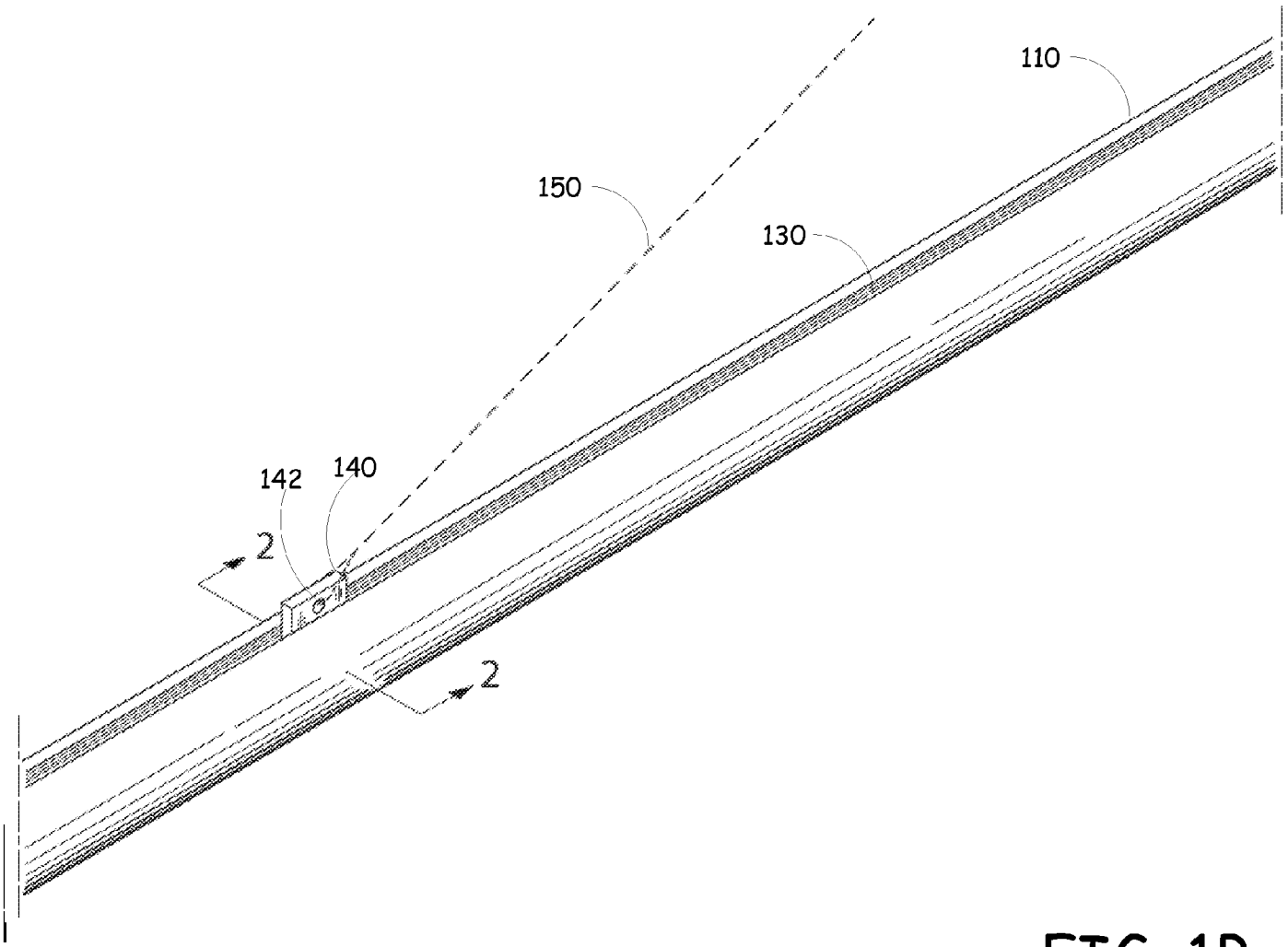
FIG. 1B is a structural drawing illustrating various aspects of an exemplary embodiment of the slider structure.

FIG. 1B is a structural drawing illustrating various aspects of an exemplary embodiment of the slider structure. In the illustrated embodiment, a portion of an arrow shaft 110 is illustrated as having or defining a channel 130 that traverses along the illustrated length of the shaft 110. As previously mentioned, the channel may extend the entire length of the shaft or, may only extend through a portion of the length of the shaft. In operation, either embodiment may be employed and the actual embodiment is more of a manufacturing decision. A slide 140 is illustrated as existing at least partially within the channel 130 and, at least partially extending out of the channel 130. The slide 140 is illustrated as including a receptor 142 for receiving an end of a string 150 or other element, such as a wire, a line, etc. In the illustrated embodiment, the receptor 142 is shown as an aperture through the slide 140 but, it will be appreciated that various configurations may exist, such as a loop attached to the slide 140, a protrusion or a hooking protrusion from the slide 140 etc.

Figure 1C:
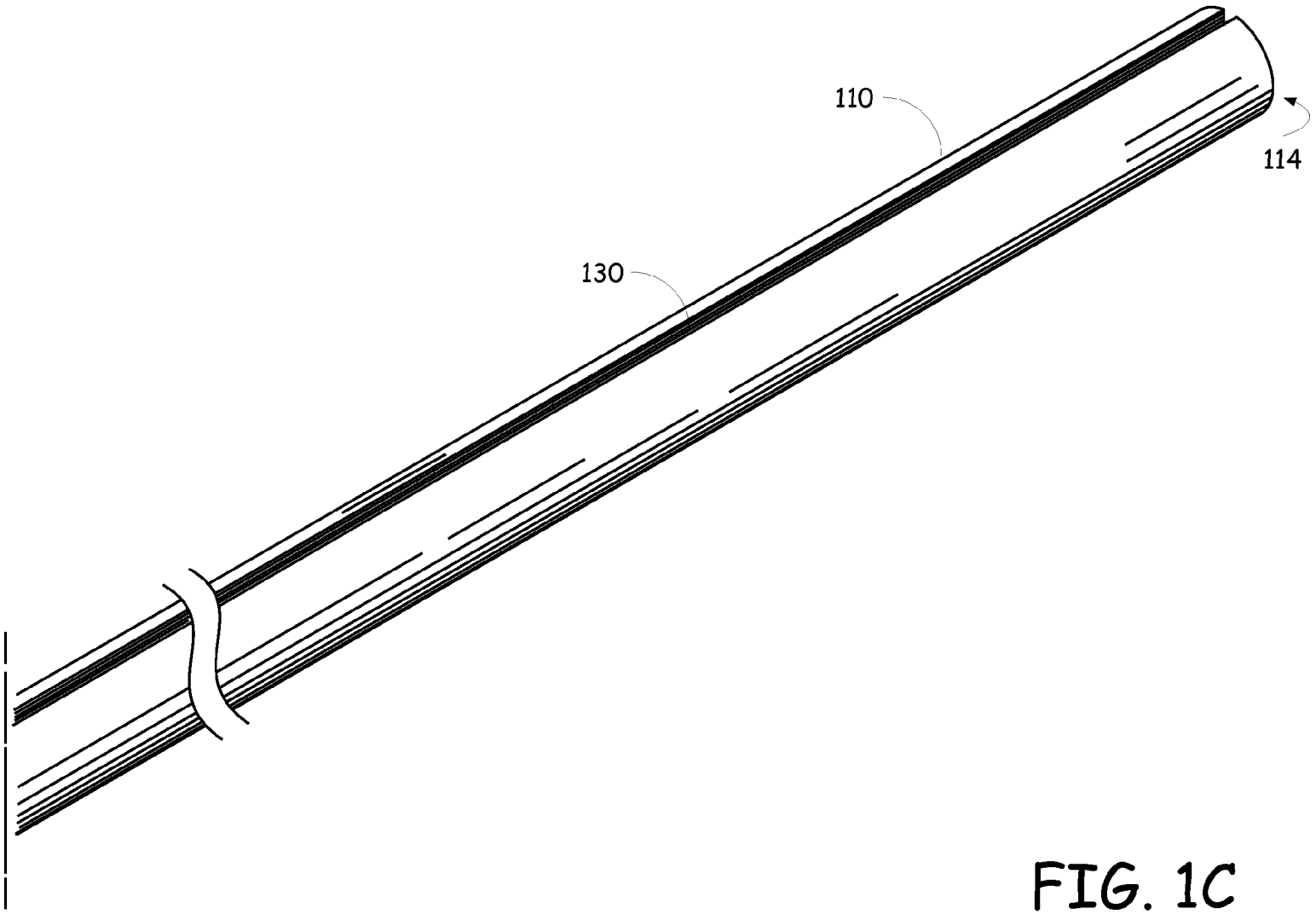
FIG. 1C is a structural drawing illustrating that the channel 130 can traverse the entire length of the shaft 110, extending to and through the end of shaft 110.

FIG. 1C is a structural drawing illustrating that the channel 130 can traverse the entire length of the shaft 110, extending to and through the end of shaft 110. Similar to illustrating the load proximate to the front end 112 of the shaft 110, a nock can be located at the rear end 114 of the shaft 110.

Figure 1D:
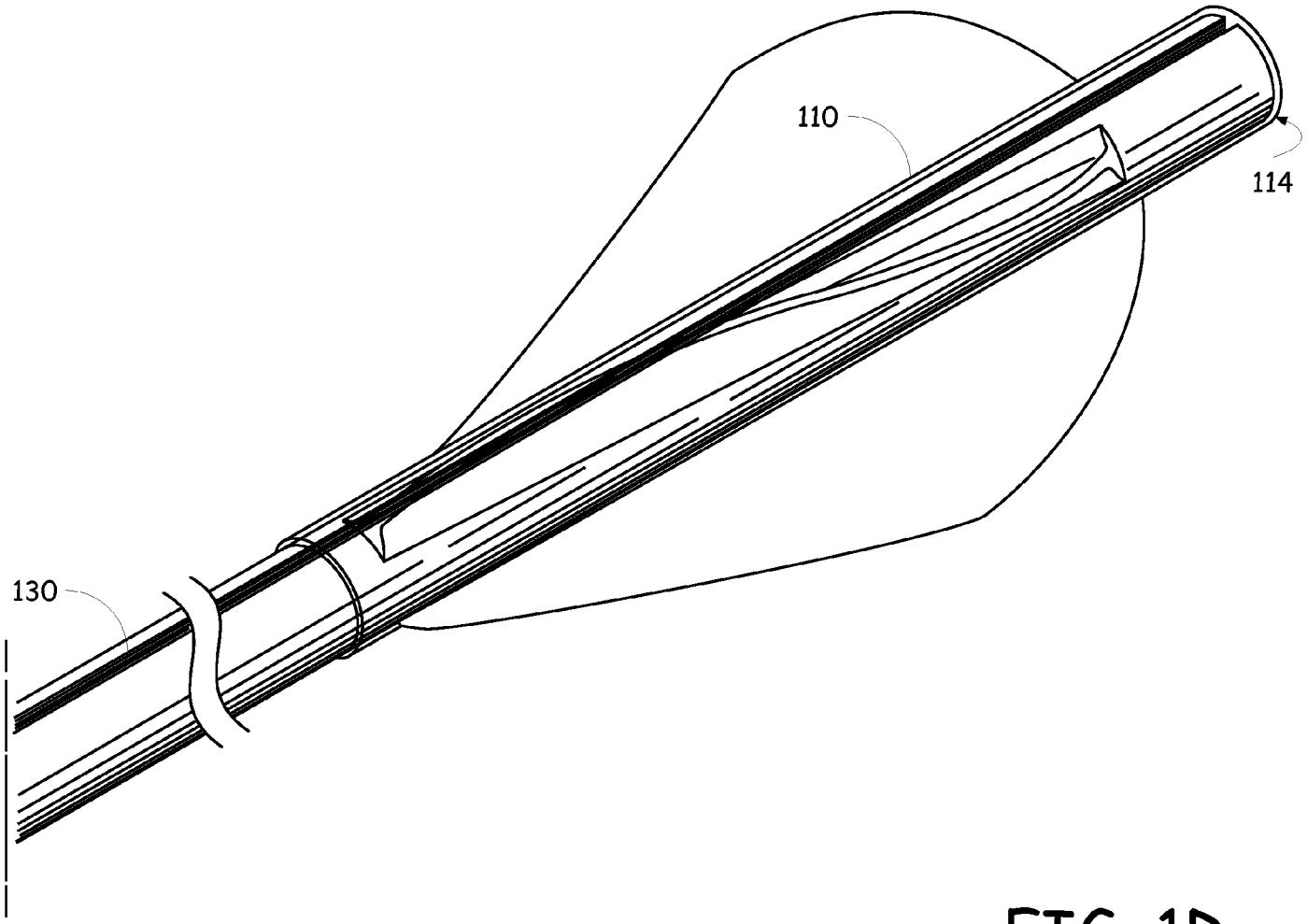
FIG. 1D is an environmental drawing illustrating the placement of fletching proximate to the rear end 114 of shaft 110.

FIG. 1D is an environmental drawing illustrating the placement of fletching proximate to the rear end 114 of shaft 110. Although as previously mentioned, bowfishing arrows do not typically utilize fletching, it is anticipated that in some applications of the present invention or various embodiments thereof, fletching may be utilized in conjunction therewith. As such, the fletching 170 would be installed proximate to the rear end 114 of the shaft 110 and cover at least a portion of the channel 130. A nock, not illustrated, would then be attached over the rear end 114.

Figure 2:
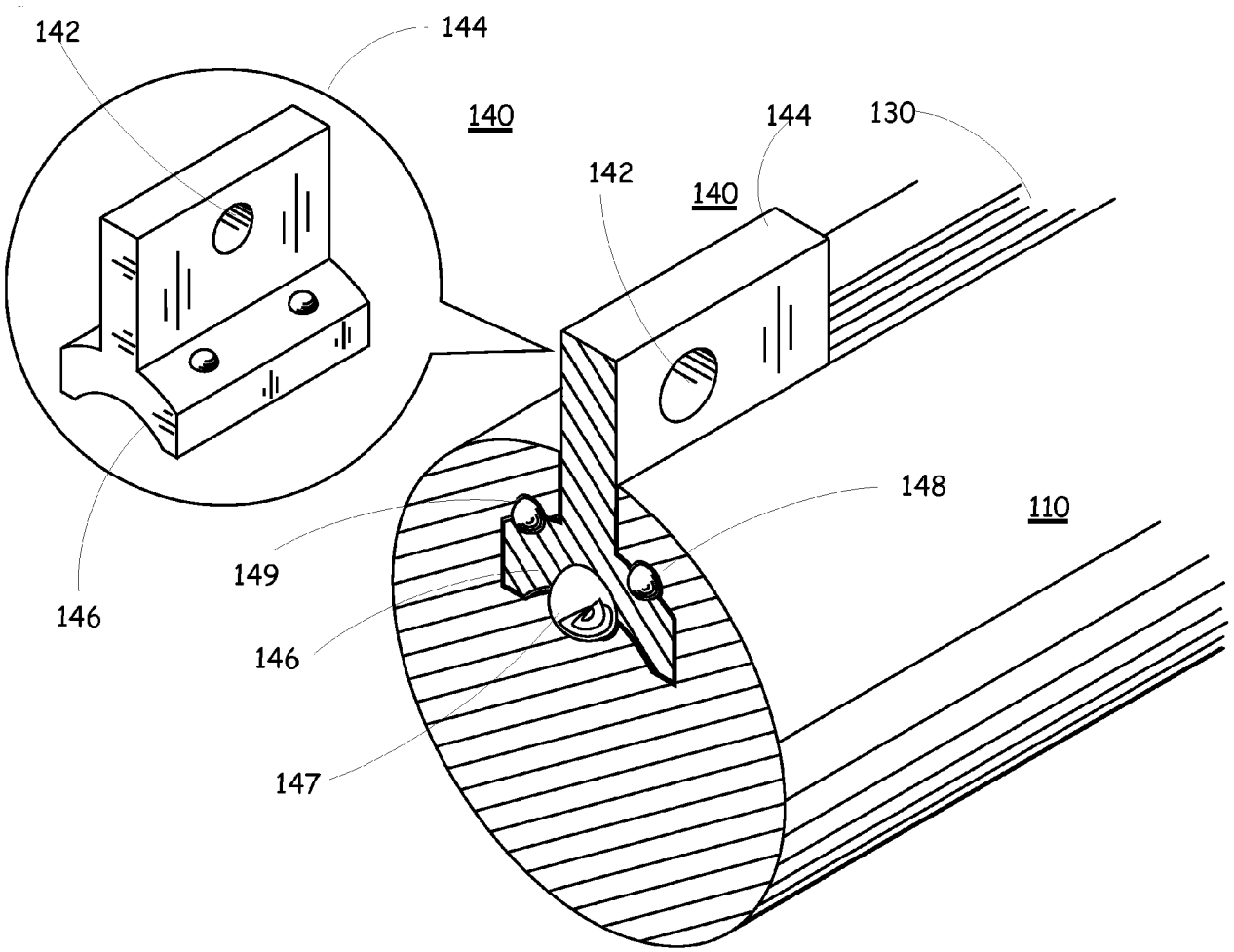
FIG. 2 is a cross-sectional diagram taken at line 2-2 in FIG. 1B.

FIG. 2 is a cross-sectional diagram taken at line 2-2 in FIG. 1B. In the illustrated embodiment, the slide 140 includes an upper portion that exists outside of the channel 130, and a lower portion or insert that exists inside the channel. The slide is illustrated as having an insert that is formed or configured in an inverted T or Y type of shape including a straight wall 144 that extends from the interior of the channel 130 to the exterior and foot, such as a flanged anchor 146 that extends outwardly from the wall 144 in a manner that corresponds with the channel 130. As will be shown below, the foot does not necessarily have to flange or extend outwardly but, in some embodiments, the foot may simply be the bottom of the wall as well as other variations. The upper portion of the slide, or the portion that connects to the foot and extends out of the channel is referred to as the tab.

In the embodiment illustrated in FIG. 2, the arrow shaft, which includes the exterior surface as well as the interior material, defines the channel. The channel in the illustrated embodiment includes a void that is defined by the walls of the shaft and is configured such that the interior void is larger than the opening into the interior void. Thus, once the foot of a slide is inserted into such a channel, the foot cannot be removed from the channel unless it slides out of the end of the shaft. The channel can be configured as shown or, be any of a variety of other shapes such as a lollypop shape, dovetail, "T", "Y", etc.

As best illustrated in the cross-sectional view of the slide 140, in the illustrated embodiment, the slide includes a friction reduction system. In the illustrated embodiment, the friction reduction system includes a lower ball bearing 147, and two upper ball bearings 148 and 149. The ball bearings 147, 148 and 149 are placed into indentations or apertures of the slide 140 and correspond with grooves in the channel 130. It will be appreciated that the ball bearings facilitate the ability for the slide 140 to quickly, easily, and with minimum force, to traverse the channel 130. Other friction reduction mechanisms and/or configurations may also be used and the illustrated embodiment is simply provided as a non-limiting example.

Figure 3:
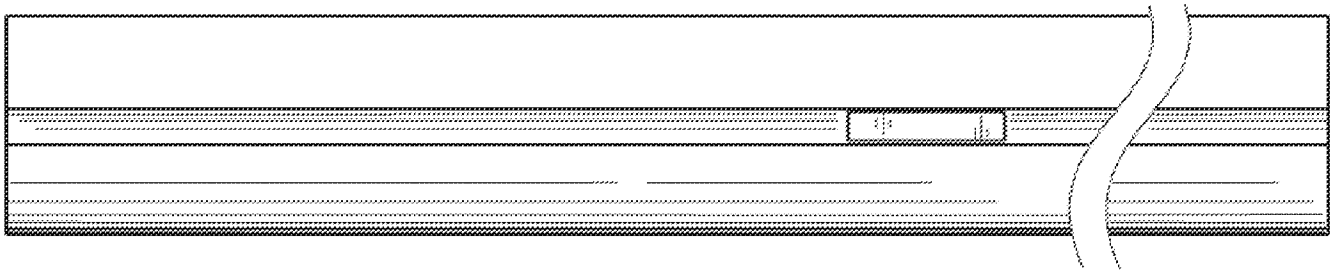
FIG. 3 is a top view of an exemplary slider system having a slide 140 positioned within the channel 130 of a shaft 110.

FIG. 3 is a top view of an exemplary slider system having a slide 140 positioned within the channel 130 of a shaft 110.

Figure 4:
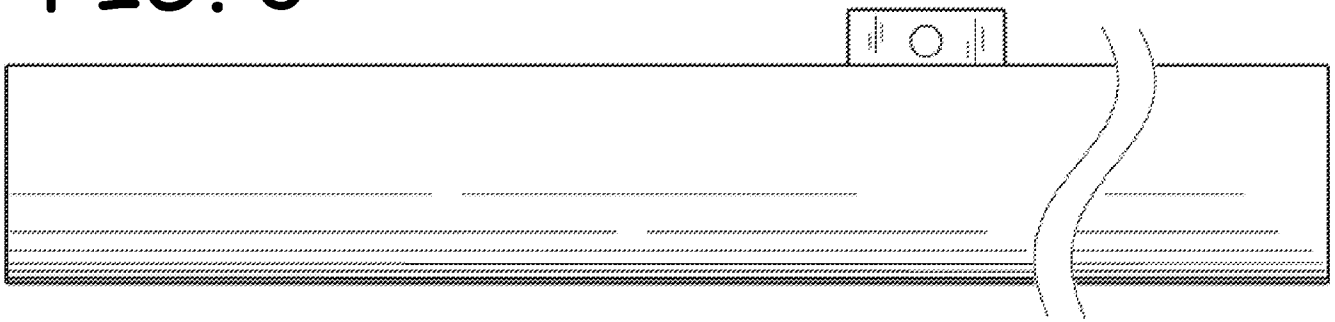
FIG. 4 is a side view of an exemplary slider system having a slide 140 positioned within the channel 130 of a shaft 110.

FIG. 4 is a side view of an exemplary slider system having a slide 140 positioned within the channel 130 of a shaft 110.

Figure 5:
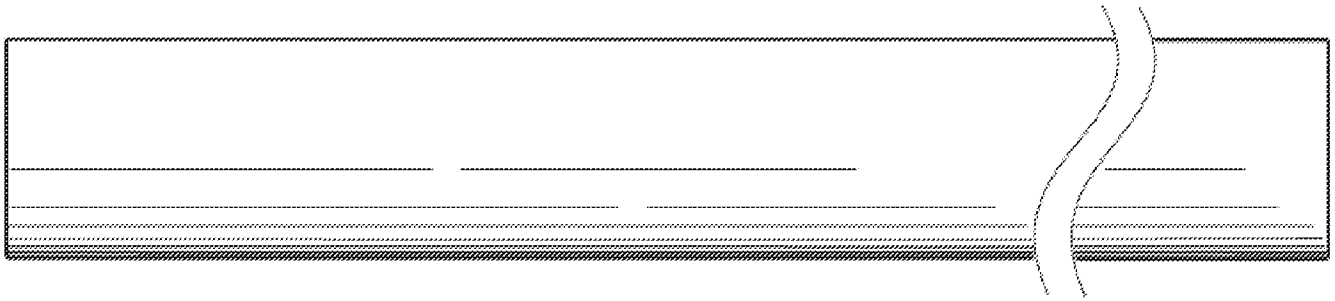
FIG. 5 is a back view of an exemplary slide system that only includes a single channel on one side of the shaft.

FIG. 5 is a back view of an exemplary slide system that only includes a single channel on one side of the shaft.

Figure 6:
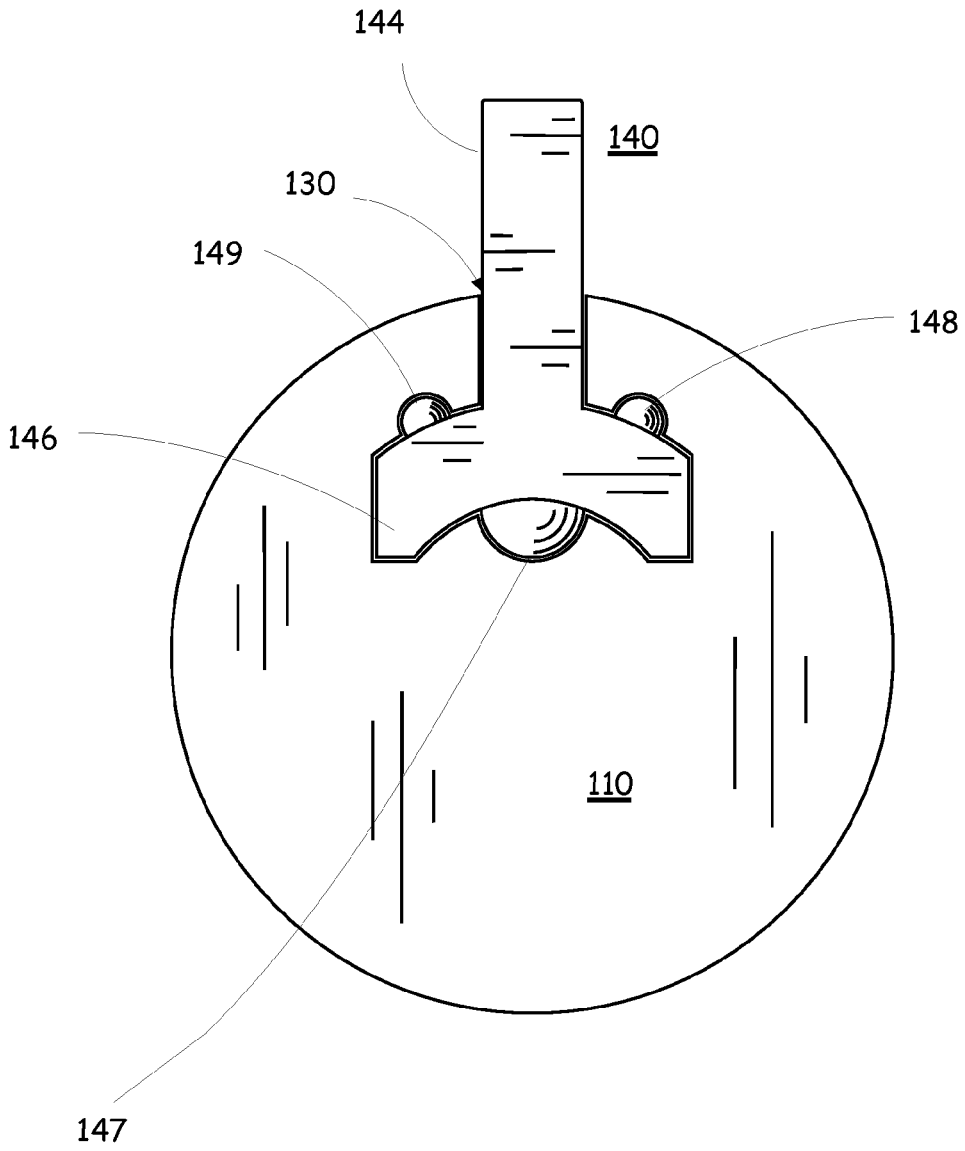
FIG. 6 is an end view of the slider system with the slide being inserted into the channel.

FIG. 6 is an end view of the slider system with the slide being inserted into the channel. As such, the slide 140 is shown as being inserted into the channel 130 of the shaft 110 such that the wall 144 is extending from the channel 130 and, the flanged anchor 146 is shown as extending within the channel 130 with the ball bearings 147, 148 and 149 cooperating with the walls of the channel 130 to create a low friction mechanism for the slide 140 to traverse the channel 130.

Figure 7:
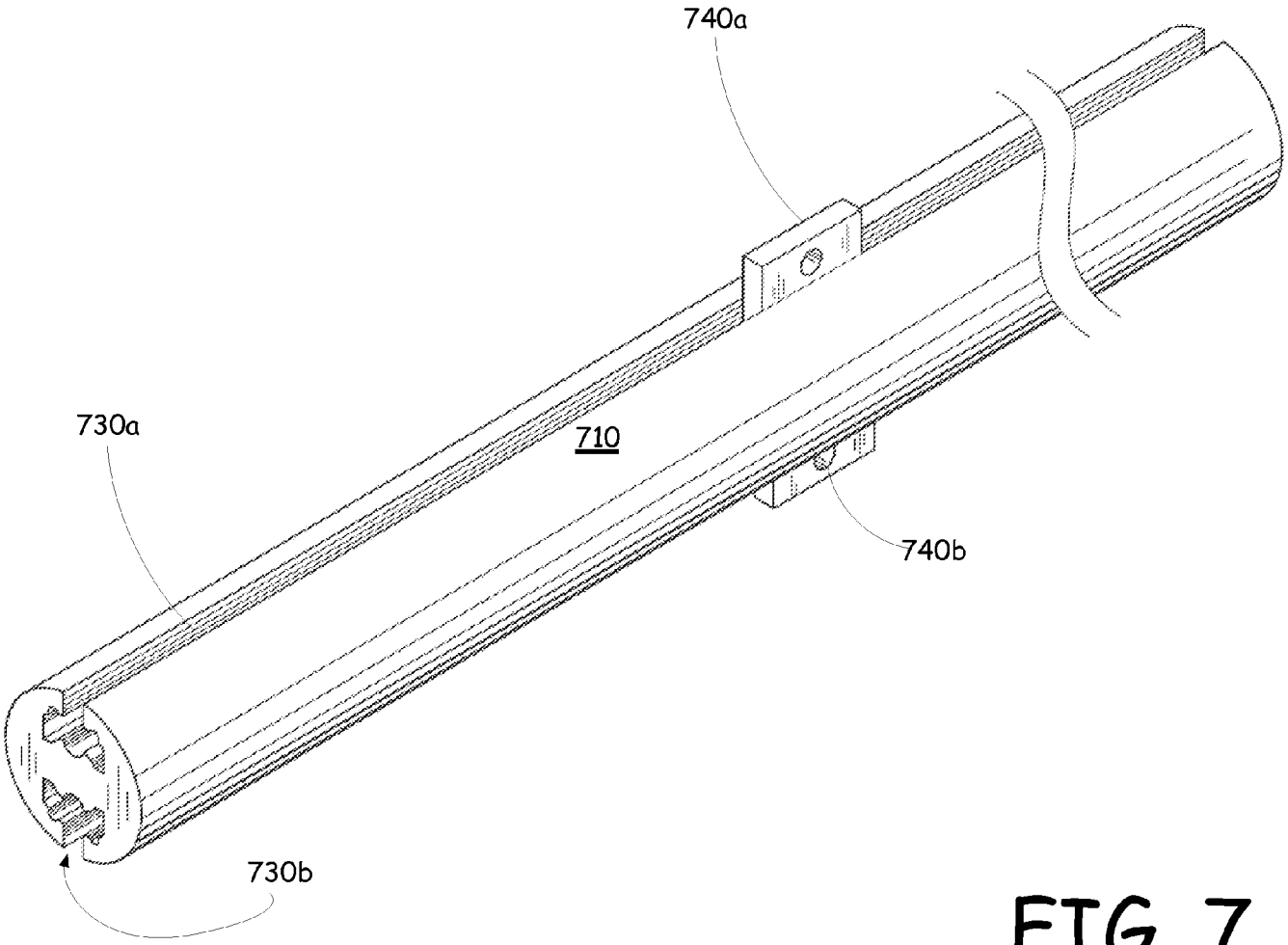
FIG. 7 is a diagram illustrating an alternative embodiment of the slider system.

FIG. 7 is a diagram illustrating an alternative embodiment of the slider system. In the illustrated embodiment, two channels 730*a* and 730*b* are shown with a slide 740*a* and 740*b* inserted thereto accordingly. In such an embodiment, either of the slides 740*a* or 740*b* may be used alone or, the slides may be used at the same time to provide further strength to the line when retracting the hunted prey.

Figure 8:
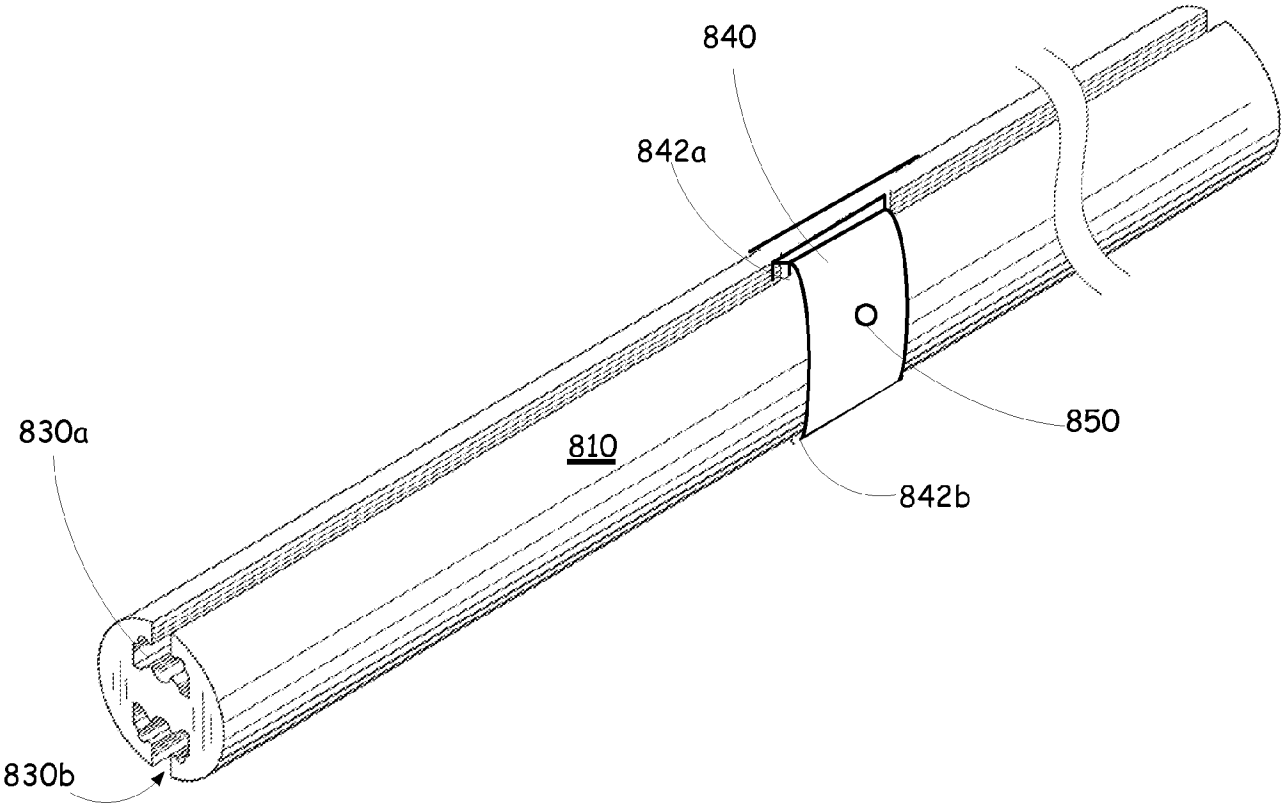
FIG. 8 is a structural diagram illustrating a single slide, dual channel embodiment of the slider system.

It will be appreciated that other configurations are also anticipated. For instance, in the two channel embodiments, a single slide may have ends that are inserted into each channel but, the walls extending out of the channel may be curved back over the shaft such that a single slide that traverses the channels is created. FIG. 8 is a structural diagram illustrating a single slide, dual channel embodiment of the slider system. In the illustrated embodiment, the shaft 810 includes channel 830*a* and 830*b*. A single slide 840 has one end 842*a* that is inserted into channel 830*a*, and a second end 842*b* that is inserted into channel 830*b*. The slide 840 includes an aperture 850, or other connection or receiving point at which a string, line or cable can be attached. In other embodiments, the slide may be configured to extend completely around the circumference of the shaft. It should be appreciated that although a single channel and a dual channel embodiment have been illustrated, other embodiments may include 3 or more channels. In some embodiments, the channels may have identical profiles while in other embodiments, the channels may have different profiles. For instance, the channels may include the anchoring flange as illustrated in FIG. 7 and FIG. 8 or, the channel may simply be a straight shaft.

Figures 9, 10:
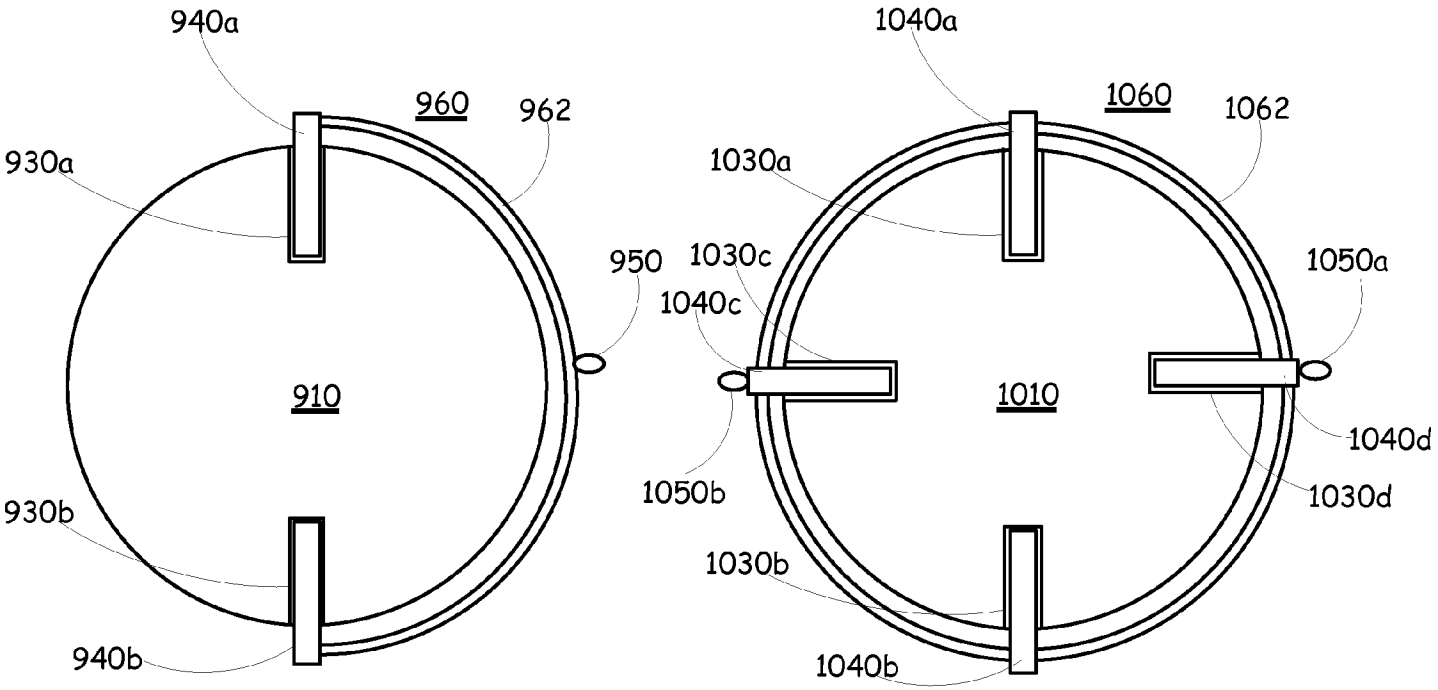
FIG. 9 is a structural end view diagram of an embodiment that includes a two channel slider.
FIG. 10 is a structural end view diagram of an embodiment that includes a four channel slider.

FIG. 9 is a structural end view diagram of an embodiment that includes a two channel slider. The shaft 910 includes two channels 930*a* and 930*b* that are simply straight cuts or channels. The slide 960 includes two walls 940*a* and 940*b* that respectively reside in channels 930*a* and 930*b* and a shell 962 that connects the two walls 940*a* and 940*b*. In such an embodiment, the foot is simply an extension of the wall. Further, a loop 950 may also be included for securing a string or line to the slide 960.

FIG. 10 is a structural end view diagram of an embodiment that includes a four channel slider. The shaft 1010 includes four channels 1030*a-d* that are simply straight cuts or channels. The slide 1060 includes four walls 1040*a-d* that respectively reside in channels 1030*a-d* and a shell 1062 that connects the four walls 1040*a-d*. One or more loops 1050*a-b* may also be included for securing a string or line to the slide 1060.

Figure 11A:
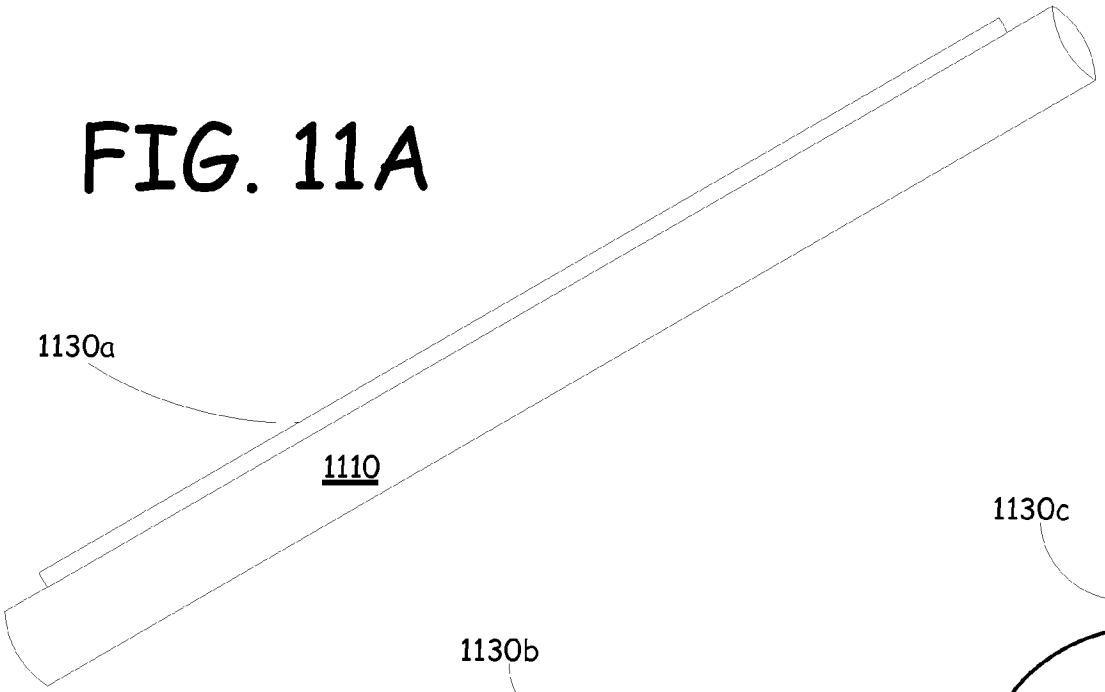
FIG. 11A is a structural diagram illustrating a channel being located on the exterior of the shaft.
Figure 11B:
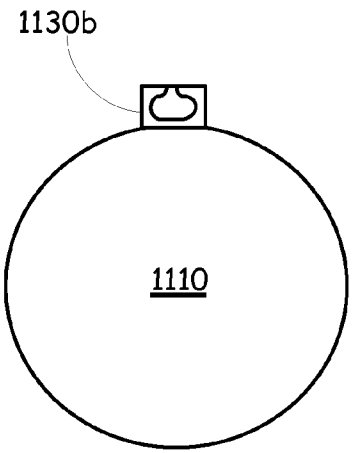
FIG. 11B illustrates a channel configuration for an exterior channel.
Figure 11C:
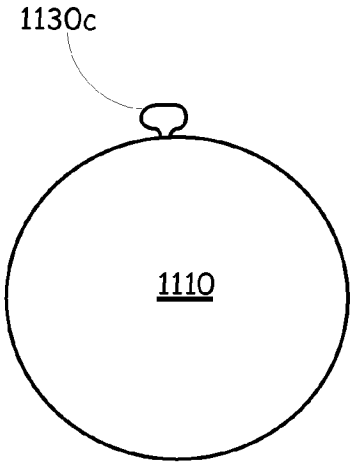
FIG. 11C illustrates an alternative embodiment that includes a rail rather than a channel.

FIG. 11A is a structural diagram illustrating a channel being located on the exterior of the shaft. The shaft 1110 includes a channel 1130*a* that is mounted, secured, molded into, or otherwise associated with the shaft 1110 but, that is on the external surface of the shaft 1110 rather than being defined within the shaft. FIG. 11B illustrates a channel configuration for an exterior channel. In the embodiment illustrated in FIG. 11B, the channel 1130*b* can receive a slider on the exterior of the arrow. FIG. 11C illustrates an alternative embodiment that includes a rail rather than a channel. In the illustrated embodiments, a rail 1130*c* is associated with the outside surface of the shaft 1110. In such an embodiment, the slider would include a channel that would slide over the rail 1130*c*. Thus, the various embodiments include a medium through which the slider can traverse a substantial portion of the length of the arrow shaft. The medium may include a channel defined by and located within the interior walls of the arrow shaft. The medium may also include an external channel mounted to or associated with the surface of the arrow shaft. The medium may also be a rail mounted to or associated with the surface of the arrow shaft. Further, the medium may include a channel and a rail located within the channel. Such a configuration may be included internal to the arrow shaft, such as within a channel of the shaft, or externally mounted to or associated with the surface of the arrow shaft.

Figure 12B:
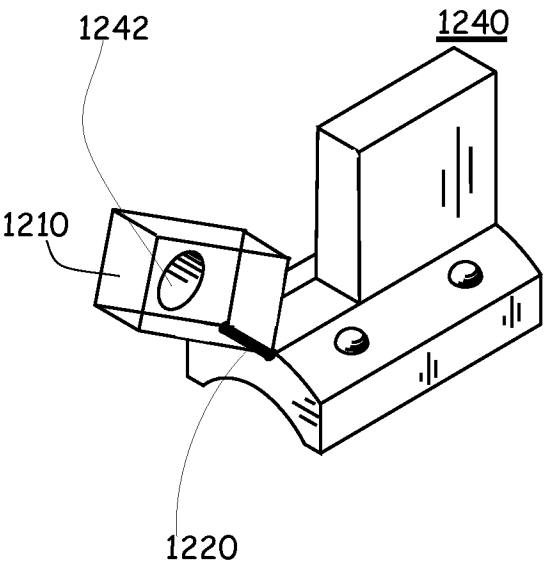
FIG. 12A and FIG. 12B illustrate two states of an embodiment with a swiveling slide.
Figure 12A:
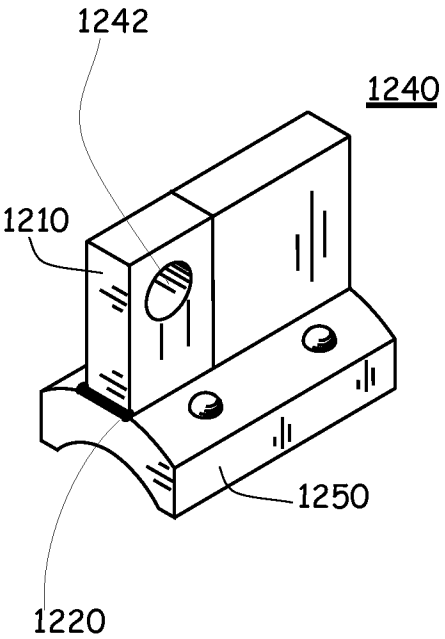

FIG. 12A and FIG. 12B illustrate two states of an embodiment with a swiveling slide. The illustrated slide 1240 is shown as including a swiveling portion 1210 to which the fishing line can be attached through connector 1242. The swiveling portion 1210 is attached to the foot portion 1250 of the slide 1240 by means of a hinge 1220. In operation, the line is attached to the slider 1240 through connector 1242 when the slider is associated with an arrow. When the arrow is drawn, the slider and the line are thus in front of the huntsman and bow. Similar to the other embodiments, once the arrow is released, the slide 1240 moves to the backside of the arrow as the arrow moves forward. In the illustrated embodiment, once the slider 1240 reaches the stop, or the stopping point, then the swiveling portion 1210 rotates around hinge 1220 such that the line is connected to the connector 1242 at a position that is behind the arrow, thus enhancing the flight of the arrow. In some embodiments, a flap can extend from the backside of the swiveling portion 1210 such that the hinge 1220 can be moved lower in the foot 1250 to even further facilitate the line extending from the rear of the arrow during flight.

Thus, it will be appreciated that various channel shape profiles may be utilize, varying numbers of channels, varying sizes of channels and various configurations of the slide may all be incorporated into various embodiments of the slider system. The channels may be straight, curved, flanged, dovetailed, or any of a variety of shapes. Thus, it will be appreciated that the particular shape and configuration of the channels and slides are presented for illustrative purposes and other shape and configuration are also anticipated.

In the various embodiments, the slide should be placed into the one or more channels and, the channels should be closed or secured to prevent the slide from coming out of the channel during operation. The slide can be secured in a variety of manners. In one embodiment the load and the nock may be used to close off or end cap the channel or channels to prevent the slide from exiting the channel during operation. However, to prevent wear and tear on the load and or nock, other mechanisms may also be utilized. For instance, a stop can be inserted into the channel at either end or both ends of the shaft. The stop would be secured into the shaft such that the slide would collide with the stop during operation and be prevented from sliding any further. In other embodiments, the channel may simply be narrowed or filled at the ends of the shaft. Other embodiments are also anticipated that would prevent the slide from exiting the channels.

In an exemplary embodiment, the fletching may operate as the slide or, stated differently, the slide may operate as the fletching. In such an embodiment, one or more elements of the fletching may exist within a channel of the shaft and prior to the arrow being fired, the portion of the fletching would rest in front of the bow and, once fired, the fletching would quickly move back into its operational position.

FIGS. 1-11C illustrate various elements, features and aspects that can be included on various embodiments of a bowfishing arrow designed to be shot from a bowfishing bow. The bowfishing bow and reel can be of any of a variety of types of bows, materials, shapes and or sizes. In general, a reel or line feeding mechanism is attached to the bow or is proximate to the bow. The arrow includes one or more channels in which a slide can be inserted and allowed to slide freely up and down the shaft of the arrow. A stop or other mechanism can be placed at the back end of the shaft or channel(s) to prevent the slide from sliding back any further along the shaft of the arrow. The slide can be inserted into the channel(s), be secured to the outside of the shaft, be attached to the end of the shaft (such as a nock or an integral part of the nock) etc. The various embodiments of the slide can be made of any number of rigid and durable materials, but preferable is made of a durable molded plastic resin material, cast aluminum, forged metal, or the like.

In operation, a fishing line is attached on one end to a bowfishing reel and on the other end, it is secured to the slide that is mounted to the arrow. When the arrow is placed into the bow and drawn back in the bow, the slide stays in front of an archer's hand and the arrow rest during the draw. As the arrow is drawn back, the slide slides forwardly along the shaft of the arrow. In a fully drawn bow, the slide traverses the shaft of the arrow to near the front of the arrow. When the bow is released, the arrow proceeds forwardly with greater force than the slide, and the slide slides is forced to move back along the shaft of the arrow. Eventually, the slide comes to rest and is forced against the stop.

Advantageously, this configuration operates to ensure that the slide and the string connected thereto remain in front of the bow and the bowstring at all times. By mounting the reel proximate to the front of the bow, only a small amount of line must be refracted from the reel and, the line remains in front of the string and bow. After the arrow is released and the slide moves to the rear of the arrow, line is pulled from the reel as the arrow moves forward. Still, the line and the arrow are all in front of the bow and as such, the risk of backlash or entanglement is minimized.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A bowfishing arrow, comprising:

an arrow shaft;

at least one channel that traverses a substantial portion of the length of the arrow shaft and running parallel with the length of the arrow shaft;

a slider including:

a foot corresponding to each at least one channel and that extends into the at least one channel;

a tab;

a string receptor for facilitating the attachment of the string to the slider;

wherein the string can be attached to the slider and, during the draw of the arrow, the slider is maintained at the front of the arrow and, once the arrow is released the slider traverses to the rear of the arrow.

2. The bowfishing arrow of claim 1, wherein the arrow shaft defines a single channel within the arrow shaft.

3. The bowfishing arrow of claim 2, wherein the single channel within the arrow shaft is defined by the walls of the arrow shaft to have an interior void that is larger than the opening into the channel.

4. The bowfishing arrow of claim 3, wherein the slider includes a friction reduction system.

5. The bowfishing arrow of claim 4, wherein the friction reduction system includes one or more ball bearings.

6. The bowfishing arrow of claim 5, wherein the slider includes receptors for the one or more ball bearings and, the arrow shaft defines grooves within the channel for the ball bearings.

7. The bowfishing arrow of claim 5, wherein the slider includes receptors for the one or more ball bearings and, the arrow shaft defines grooves within the channels for the ball bearings.

8. The bowfishing arrow of claim 4, wherein the friction reduction system includes one or more ball bearings.

9. The bowfishing arrow of claim 1, wherein the arrow shaft defines a plurality of channels within the arrow shaft.

10. The bowfishing arrow of claim 9, wherein the plurality of channels within the arrow shaft are defined by the walls of the arrow shaft to have an interior void that is larger than the opening into the channel.

11. The bowfishing arrow of claim 10, wherein the slider includes a friction reduction system.

12. A bowfishing arrow, comprising:

an arrow shaft;

a plurality of channels that traverses a substantial portion of the length of the arrow shaft and run parallel with the length of the arrow shaft;

a slider foot corresponding to each at least one channel and that extends into the at least one channel;

a slider tab corresponding to each slider foot;

a string receptor for facilitating the attachment of the string to the slider;

wherein the string can be attached to the slider and, during the draw of the arrow, the slider is maintained at the front of the arrow and, once the arrow is released the slider traverses to the rear of the arrow.

13. The bowfishing arrow of claim 12, wherein each slider foot and tab combination can move independent of each other.

14. The bowfishing arrow of claim 12, wherein the slider tabs are secured to each other such that the slider foot and tab combinations slide in tandem.

15. The bowfishing arrow of claim 14, wherein the slider includes a friction reduction system.

16. The bowfishing arrow of claim 15, wherein the friction reduction system includes one or more ball bearings.

17. The bowfishing arrow of claim 16, wherein the slider includes receptors for the one or more ball bearings and, the arrow shaft defines grooves within the channels for the ball bearings.

18. A bowfishing arrow, comprising:

an arrow shaft;

a medium selected from the group consisting of: a channel defined within the interior of the arrow shaft; and an medium external to and on the surface of the arrow shaft that traverses a substantial portion of the length of the arrow shaft and running parallel with the length of the arrow shaft;

a slider including:

a foot for mating with the medium;

a tab;

a string receptor for facilitating the attachment of a string to the slider;

wherein the string can be attached to the slider and, during the draw of the arrow, the slider is maintained at the front of the arrow and, once the arrow is released the slider traverses to the rear of the arrow.

19. The bowfishing arrow of claim 18, wherein the medium is a channel defined within the interior of the arrow shaft.

20. The bowfishing arrow of claim 18, wherein the medium is defined external to and on the surface of the arrow shaft.

* * * * *